US005516109A

United States Patent [19]

Desjardins

[11] Patent Number: 5,516,109

[45] Date of Patent: May 14, 1996

[54] MODULAR AND INTERCHANGEABLE GOLF PUTTING PLATFORM

[76] Inventor: Pierre Desjardins, 870 Montée Sainte-Thérèse, Bellefeuille, Québec, Canada, J0R 1A0

[21] Appl. No.: 369,914

[22] Filed: Jan. 6, 1995

[51] Int. Cl.[6] ..... A63B 67/02

[52] U.S. Cl. ..... 473/162; 473/160

[58] Field of Search ..... 273/176 R, 176 F, 273/176 H

[56] References Cited

U.S. PATENT DOCUMENTS

| | | | |
|---|---|---|---|
| 1,856,816 | 5/1932 | Luddy | 273/176 F |
| 3,727,917 | 4/1973 | MacLean | 273/176 H |
| 4,018,436 | 4/1977 | Leigh | 273/176 H X |
| 4,098,507 | 7/1978 | Hudon | 273/176 H |

*Primary Examiner*—William H. Gried

[57] ABSTRACT

A modular golf putting platform is comprised of at least two platform sections interconnected together at abutment ends. Each platform section or semi-integral section without the carpet glued to the top wall has opposed side walls, end walls, and a top wall having an upper putting surface. A cup for receiving a golf ball is mounted under a hole formed in the upper putting surface of at least one of the platform sections. Support brackets are detachably secured to a lower edge of the side walls for supporting the platform sections on a support surface. A bracket connecting element is provided for interconnecting the brackets, and therefore the platform sections. The support brackets have height adjusting elements to align the upper putting surface of adjacent platform sections in a substantially common plane.

15 Claims, 3 Drawing Sheets

MODULAR AND INTERCHANGEABLE GOLF PUTTING PLATFORM

TECHNICAL FIELD

The present invention relates to a modular golf putting platform formed of platform sections which are interconnected and adjusted by support brackets, the platform being of the type for use with a network of other platforms for the practice of putting.

BACKGROUND ART

Amusement parks comprised of a series, usually eighteen, golf putting surfaces are known for the practice of putting and for amusement. The majority of these golf amusement parks consists in the fabrication of a plurality of putting surfaces, on site, by pouring concrete into forms which delineates each of the putting surfaces with a cup embedded in the concrete to constitute a golf hole. A grass-imitation carpet is then glued to the top surface of the concrete after it has set. Alternatively, the top surface may be painted, such as with green paint, to imitate a grass surface. The putting surface may also be provided with various obstacles; may be undulated; and the fabrication of such obstacles is usually done on site and such is labor-intensive.

A disadvantage of these known putting practice amusement sites is that the layout or course of the putting surfaces is fixed and cannot be changed easily, and they become monotonous to the user. That is to say, the user will become bored with always playing on the same golf putting surfaces. It is possible to interchange platforms but not to change the shape of one or more, or all platforms by interconnecting platform sections.

Another disadvantage of known prior art putting amusement sites is that they are expensive to construct and time-consuming to erect, and very difficult to repair for the reason that most of the surfaces are made of concrete.

A further disadvantage of some of these sites is that the platforms are made of wood and are rapidly damaged by weather conditions, such as rain, snow, frost, sun, etc.

SUMMARY OF INVENTION

There is therefore a need to provide a golf putting practice amusement site which overcomes the above-mentioned disadvantages, and which can be erected quickly, which is easy to repair, and which can be modified occasionally to change the configuration of the putting course, that is to say, to modify the putting surfaces.

Another feature of the present invention is to provide a modular golf putting platform which is comprised of platform sections which are interconnectable together with or without support brackets which are detachably secured thereto.

Another feature of the present invention is to provide a modular golf putting platform incorporating support brackets which provide for easy interconnection and adjustment of the platform sections.

Another feature of the present invention is to provide a modular golf putting platform incorporating support brackets which permit platform sections to be hinged out of connection with adjacent platform sections for repair or change thereto.

Another feature of the present invention is to provide a modular golf putting amusement site incorporating a plurality of modular golf putting platforms formed of platform sections which may be interchangeable to vary the shape of the platform or the layout of some or all of the platforms utilized in the amusement area.

According to the above features, from a broad aspect, the present invention provides a modular golf putting platform comprised of at least two platform sections interconnected together. Each platform section has opposed side walls, end walls, and a top wall having an upper putting surface. A cup for receiving a golf ball is mounted under a hole formed in the upper putting surface of at least one of the platform sections. Support means are detachably secured to a lower edge of the side walls for supporting the platform sections on a support surface. Means is also provided for interconnecting the platform sections together. The support brackets have height adjustment means to align the upper putting surface of adjacent platform sections in a substantially common plane.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
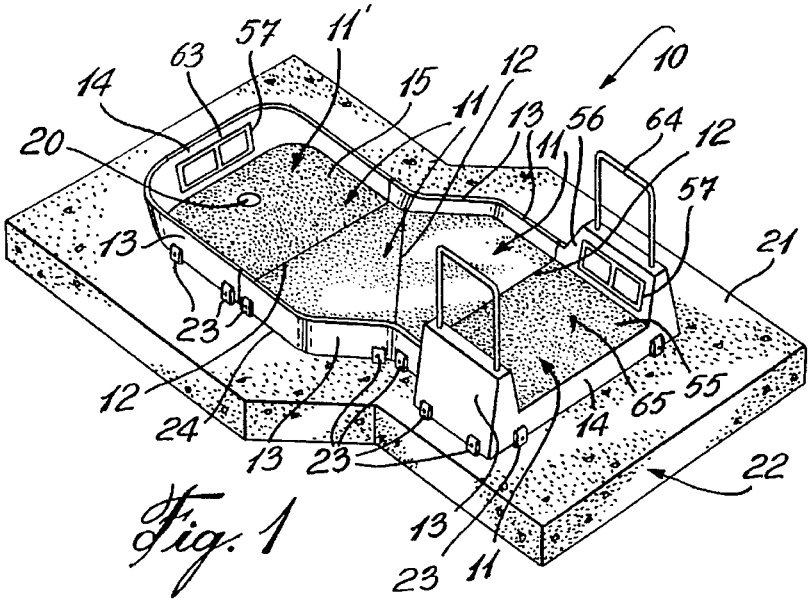
FIG. 1 is a perspective view of a modular golf putting platform constructed in accordance with the present invention and secured on any support surface, herein a concrete slab.
Figure 2:
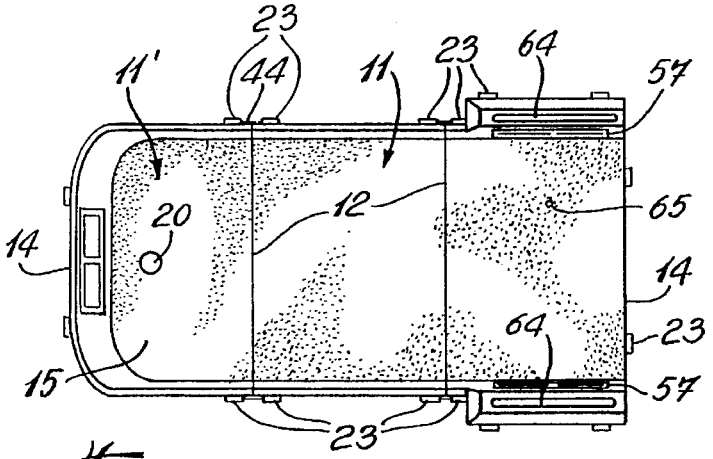
FIG. 2 is a top view showing the modular golf putting platform of the present invention comprised of three platform sections interconnected together.
Figure 10:
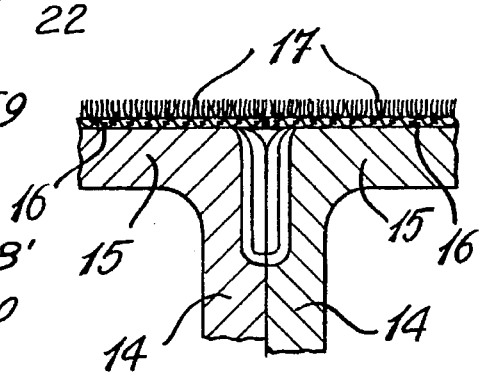
FIG. 10 is a fragmented section view showing end sections of two platform sections in abutting interconnected relationship.

Referring now to the drawings, and more particularly to FIGS. 1 and 2, there is shown generally at 10 the modular golf putting platform of the present invention which is comprised of at least two, herein four, platform sections 11 interconnected at connecting ends 12. Each platform section is formed as an integral section and has opposed side walls 13, end walls 14, and a top wall 15 having an upper putting surface 16, as shown in FIG. 10, and having a grasssimulated carpet 17 glued thereon, or held in place by other means, such as screws, snaps, tape, bracing or VELCRO.

Figure 9:
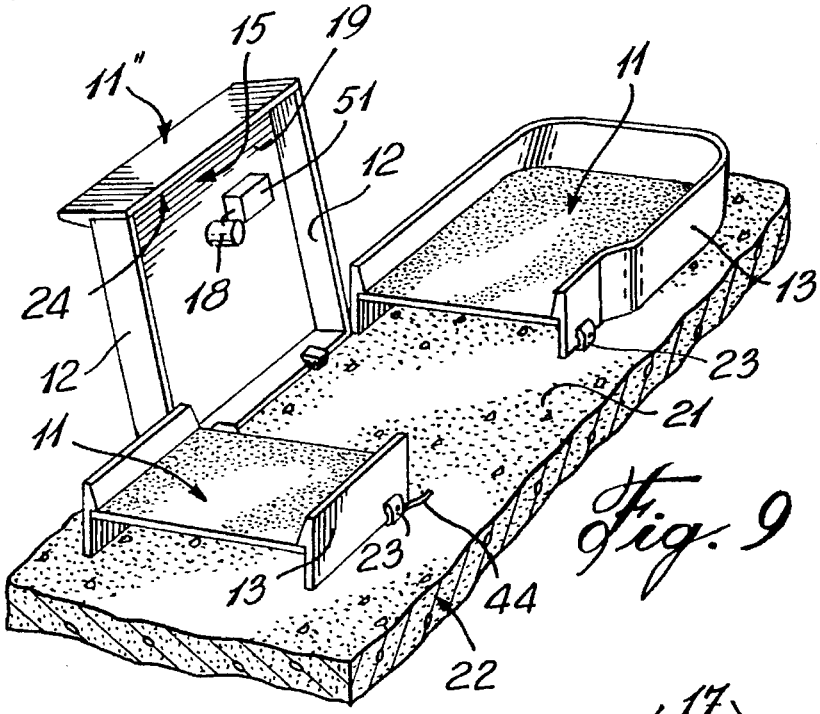
FIG. 9 is a perspective view showing a platform section hinged out of a modular golf putting platform to effect repairs or for interchanging same.

As shown in FIGS. 1 and 9, a cup or tee 18 is secured to the bottom surface 19 of the top wall 15 under a hole 20 formed in the top wall 15 of at least one of the platform sections 11, herein the end section 11'. Each of the platform sections 11 is supported on a support surface 21, herein provided by a concrete slab 22 although a multitude of other support surfaces may be provided. These platform sections are supported on support brackets 23 which are detachably secured to a lower edge 24 of the side walls 13. These brackets 23 also hold the platform sections 11 in end-to-end abutment. The brackets 23 further provide height adjustment means to align the upper putting surface, that is to say, the top walls 16 of adjacent platforms in a substantially common plane, as shown in FIG. 10.

Referring now to FIGS. 3 to 9, there will be described the construction and operation of the support brackets 23. As shown in a perspective view of FIG. 3, the support bracket 23 comprises an inner platform support member 25 which is of generally rectangular configuration and which has a flat lower support surface 26 provided with a friction gasket 27 which prevents sliding displacement on the support surface 21 of the concrete 22. The gasket 27 may be a rubber strip glued to the surface 26. An outer clamp member 28 is threadably secured to the support member 25 by means of the threaded screw 29 extending into the non-threaded bore 30 of the outer clamp member and engaged within the inner serrated face 31 of the inner platform support member 25. The outer clamp member 28 is also provided with a rubber gasket 32 in an inner face 33 thereof adjacent the serrated face 31 to clamp on the outer side wall surface 13' of the platform section. A slot 34 is defined between the inner face 31 of the inner platform support member 25 and the inner face 33 of the outer clamp member 28.

The support bracket 23 is further provided with height adjustment means in the form of a threaded, vertically adjustable support screw 35 disposed in a vertical cavity 36 formed in the base portion 38 of the support member 25 and disposed partly within the inner serrated face 31 of the inner platform support member 25. This support screw 35 is threadably secured in a threaded cavity 37 formed in the base portion 38 of the inner platform support member 25, as better shown in FIG. 6. The support screw 35 has a head with a flat support surface 39 which extends partly within the clamping slot 34 to provide support engagement with the bottom edge 40 of a side wall 13 of a platform section, as clearly illustrated in FIG. 6. A tool engaging cavity 41 is provided in the head of the screw 35 to provide height adjustment thereof. Accordingly, by threading or unthreading the screw 35 the height between the support surface 39 of the screw head supporting the bottom edge of the side wall 13 of the panel and the ground surface is made adjustable. It is foreseeable that the screw 35 may be replaced by other adjustable means, such as wedge blocks or levers, not shown.

Figure 3:
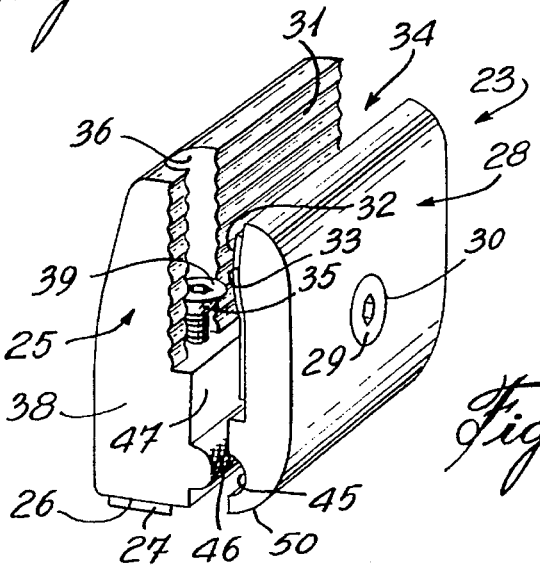
FIG. 3 is a perspective view showing the construction of the platform support bracket.
Figure 7:
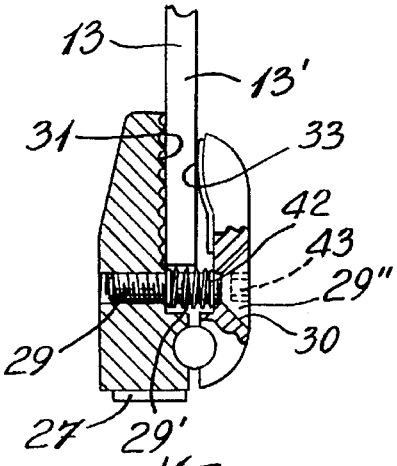
FIG. 7 is a section view through section line VII—VII of FIG. 4.

As also shown in FIGS. 3 and 7, the outer clamp member 28 is spring-biased with the inner platform support member 25 by means of a helical spring 42 disposed about the threaded shaft 29' of the screw 29 and held captive between the inner surface 31 of the inner platform support member 25 and the inner surface 33 of the outer clamp member 28. A tool engaging cavity 43 is also provided in the screw head 29" for threaded adjustment thereto to clamp the lower edge section 13' of the side wall 13 between the inner surfaces 31 and 33.

Figure 4:
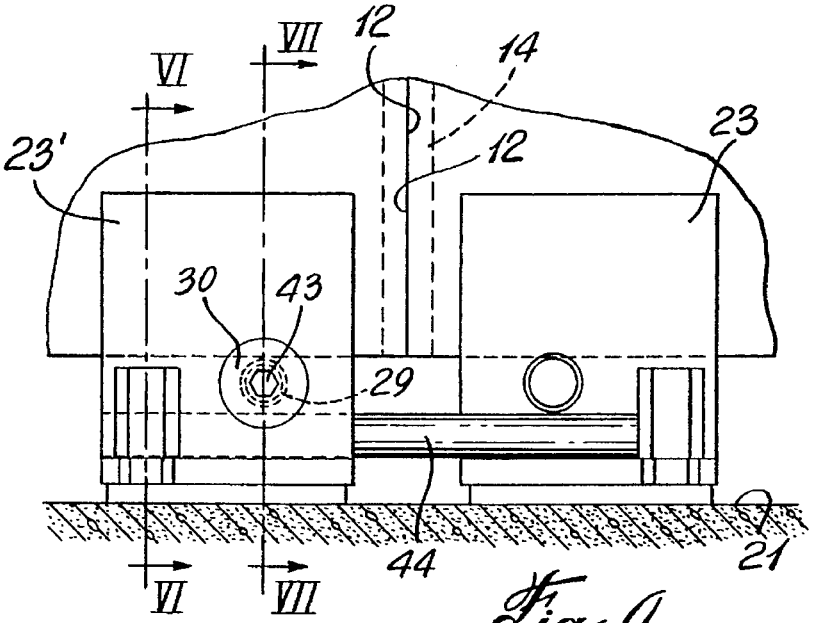
FIG. 4 is a side view showing two platform sections interconnected together by two support brackets.
Figure 5:
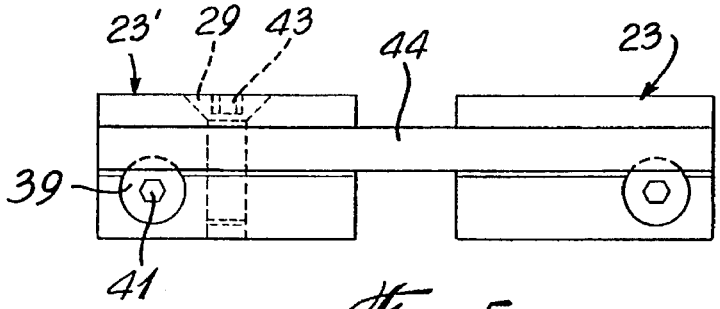
FIG. 5 is a top view of the two support brackets of FIG. 4, but with the platforms removed.
Figure 6:
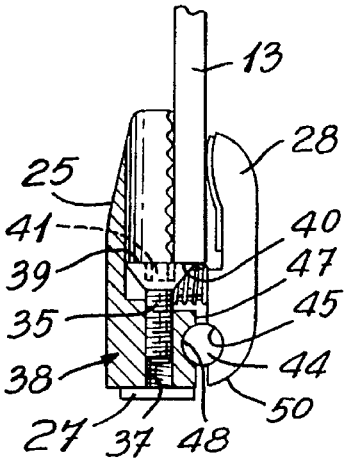
FIG. 6 is a section view through section line VI—VI of FIG. 4.
Figure 8:
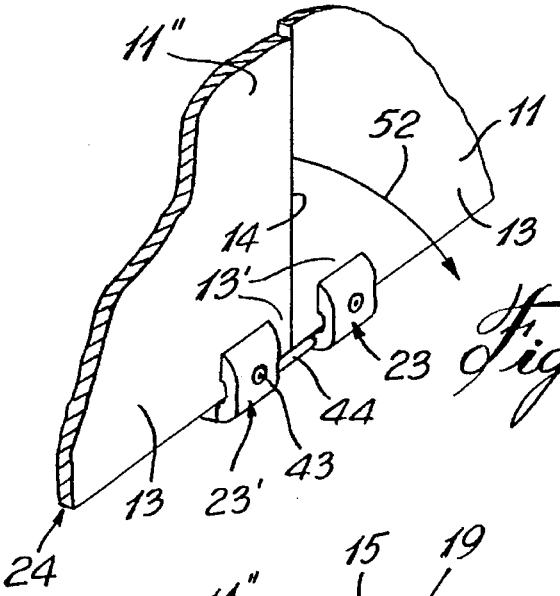
FIG. 8 is a fragmented perspective view showing how the support brackets interconnect adjacent platform sections and how the sections may be hinged while being connected along an edge to an adjacent platform section.

As can be seen more clearly from FIGS. 3, 4 and 8, the platform sections 11 are interconnected by the support brackets 23 which are secured adjacent a lower edge section 13' of adjacent panels and placed close to the end walls 14. The interconnection is effectuated by a metal rod 44 which is clamped within a slot 45 provided in a lower section of the outer clamp member 28 below the threaded fastener 29. A beaded formation 46 may be provided in the mating lower surface 47 of the inner platform support member 25 and may have serrations thereon to provide positive engagement of the metal rod 44 extending therebetween. Alternatively, as shown in FIGS. 6 and 7, the lower surface portion 47 may also be provided with a cavity 48 to clamp the cable 44 between opposed cavities. The inner face of these cavities may also be serrated or have a rough finish to provide more positive clamping. It is also pointed out that instead of a rigid metal rod 44 the interconnection may also be made by a flexible metal cable. This cable or rod should have a certain rigidity to prevent the panels from separating once they are interconnected. The interconnection is made by tightening the screws 43 in each of the adjacent support brackets 23.

As is also illustrated in FIGS. 3, 6 and 7, it can be seen that the outer clamp member 28 is provided with an outwardly curved lower edge 50 to permit a platform section, such as section 11" shown in FIG. 9, to be hinged on its side while remaining connected to one or more of the opposed platform sections 11. This provides for access to the bottom surface 19 of the platform to effectuate repairs or to replace the cup 18, or work on electrical controls, or to interchange mechanically operated device, such shown at 51, and which are associated with the cup 18. It also permits one to interchange the cup or to secure the cup elsewhere and plug the existing hole 20. When the platform section 11' is tilted the outwardly curved lower edge 50 will abut against the support surface 21 of the concrete slab 22 thereby lifting the rubber pad or gasket 27 clear from the concrete not to damage same. The arc also provides a fulcrum for the interconnected assembly consisting of the two interconnected support brackets 28, as shown in FIG. 8. FIG. 8 shows the side wall 13 panel 11" being tilted in the direction of arrow 52 while the other platform section 11 remains stationary in a vertical plane. The screw 43 in the support bracket 23' is slackened to release the friction between the clamping cavities and the cable or rod 44.

Figure 11:
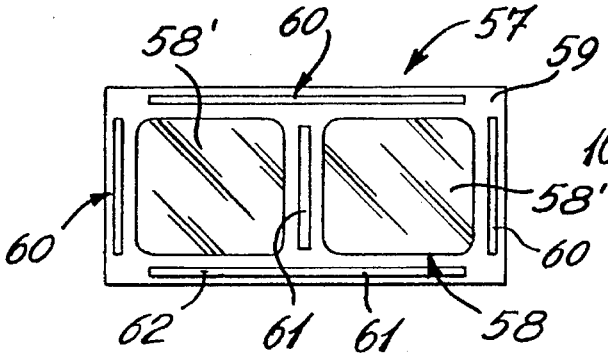
FIG. 11 is a rear view of a transparent panel for securement over the inclined inner surfaces of a tee-off platform section or other platform sections.

As shown in FIG. 1, some of the platform sections are provided with side walls 13 which extend above the top putting surface 15. These elevated side walls, such as the one on the tee-off platform 55, or the end wall of end platform 11, are more elevated and define outwardly inclined inner surfaces 56 on which one or more transparent panels 57 are detachably connected. These panels define pockets therebehind to retain advertising sheet material which is visible through transparent panels 58 provided therein. Such transparent panels 57 are shown in FIG. 11 and are formed by a sheet of plastic material having an opaque contour section 59 to delineate window openings 58' therein. Double-sided adhesive tape 60, or snaps, may be provided along opposed side edges of the panel and the top and bottom edge of the panels 58', as herein shown, to secure the panel to the side wall 56. The bottom edge sections 61 and intermediate sections of the panel may be provided with adhesive strips having an outer magnetic surface 62 secured thereto and also secured to the inclined side wall 56. Accordingly, by pulling out the lower edge 61 of the panel the magnetic strips are separated and advertising sheet material (not shown) may be positioned behind the window areas 58' and over the inclined side wall 56. These panels may also be secured on the inclined side wall 63 of the end platform section 11'. Safety rails 64 may also be secured to the top edge of the side walls 13 of the tee-off platform 55 to protect people from falling off, particularly if a water-jet (not shown) is secured under the tee 65, as this will cause the user to suddenly back off from the tee, and these rails will prevent them from falling off the platform.

It is pointed out that the platform sections 11 of the present invention are formed of fiberglass material, but these may also be molded of rigid plastics material of wood, cardboard fiber, or other materials of similar nature. Also the abutment end walls 14 may not extend to the support surface and may be provided as flange walls only to provide rigidity to the putting surfaces. Ribs or laminated materials may also be provided in the bottom surface of the putting surfaces to add rigidity to the structure. Other obvious modifications may also be made to the preferred embodiment, and it is intended to cover these provided they fall within the scope of the appended claims.

I claim:

1. A modular golf putting platform comprising at least two independent platform sections interconnected together; each platform section having opposed side walls, end walls, and a top wall having an upper putting surface; a cup for receiving a golf ball mounted under a hole formed in said upper putting surface of at least one of said platform sections, support means detachably secured to a lower edge of said side walls for supporting said platform sections on a support surface, means for interconnecting said platform sections together, said support means having height adjustment means to align said upper putting surface of adjacent platform sections in a substantially common plane, said support means being support brackets, each said support brackets having an inner platform support member provided with a lower support surface, and an outer clamp member; a section of said lower edge of said side walls being received in clamping support engagement between said inner platform support member and outer clamp member.

2. A modular golf putting platform as claimed in claim 1 wherein said means for interconnecting said platforms is a bracket connector for interconnecting two adjacent brackets.

3. A modular golf putting platform as claimed in claim 2 wherein said height adjustment means comprises a threaded, vertically adjustable support element threadably secured in said inner platform support member, said support element having a support surface disposed in a clamping slot defined between said inner platform support member and said outer clamp member.

4. A modular golf putting platform as claimed in claim 3 wherein said outer clamp member is threadably secured against an outer clamp face of said inner platform support member by means of a threaded member having an engaging head disposed in an outer face of said outer clamp member, and spring biasing means between said inner platform support member and said outer clamp member.

5. A modular golf putting platform as claimed in claim 4 wherein said spring biasing means is a helical spring disposed about a threaded shaft of said threaded member and held in compression therebetween, said threaded member having a tool engaging cavity in said engaging head.

6. A modular golf putting platform as claimed in claim 3 wherein said support element is a screw having a flanged head with a flat top face, said flanged head extending at least partly within said clamping slot for support of a lower edge of said platform section sidewalls.

7. A modular golf putting platform as claimed in claim 2 wherein a friction gasket is secured to said lower support surface of said inner platform support member to arrest sliding displacement of said platform of said support surface.

8. A modular golf putting platform as claimed in claim 2 wherein there is further provided cable engagement means in mating surfaces of said inner platform support member and said outer clamp member to clamp a connecting cable between two of said support brackets secured to a side wall of adjacent platform sections with an end wall of each said section in abutment to interconnect said platform sections together.

9. A modular golf putting platform as claimed in claim 2 wherein said outer clamp member is provided with an outwardly curved lower edge whereby to permit a platform section to which it is connected to be hinged on its side while remaining connected to one or more opposed platform sections.

10. A modular golf putting platform as claimed in claim 1 wherein said platform sections have elevated side walls, at least some of said elevated side walls having outwardly inclined inner surfaces, one or more transparent panels disposed over said inclined inner surfaces and having pocket means therebehind to retain advertising sheet material therein and visible through said transparent panels.

11. A modular golf putting platform as claimed in claim 10 wherein one of said platform sections is a tee-off platform section which is provided with safety rails above opposed elevated side walls thereof.

12. A modular golf putting platform as claimed in claim 10 wherein said top wall of said platform sections are recessed from said side walls.

13. A modular golf putting platform as claimed in claim 1 wherein there are three or more interconnected platform sections, said sections being of different configuration and each having straight abutment end walls.

14. A modular golf putting platform as claimed in claim 1 wherein said support surface has a top level surface.

15. A modular golf putting platform as claimed in claim 1 wherein said platform sections are formed of fiberglass, wood, cardboard fiber, or other similar materials, said abutment end walls of adjacent interconnected platform sections being flange walls, said side walls and end walls being reinforcing walls for said top wall.

* * * * *